US009842560B2

(12) United States Patent
Kim et al.

(10) Patent No.: US 9,842,560 B2
(45) Date of Patent: Dec. 12, 2017

(54) SOURCE DRIVER AND DISPLAY DEVICE INCLUDING THE SAME

(71) Applicant: SILICON WORKS CO., LTD., Daejeon-si (KR)

(72) Inventors: Young Bok Kim, Daejeon-si (KR); Young Tae Kim, Seoul (KR); Joon Ho Na, Daejeon-si (KR)

(73) Assignee: SILICON WORKS CO., LTD., Daejeon-si (KR)

( * ) Notice: Subject to any disclaimer, the term of this patent is extended or adjusted under 35 U.S.C. 154(b) by 52 days.

(21) Appl. No.: 14/875,945

(22) Filed: Oct. 6, 2015

(65) Prior Publication Data

US 2016/0098966 A1 Apr. 7, 2016

(30) Foreign Application Priority Data

Oct. 6, 2014 (KR) ..... 10-2014-0134184

(51) Int. Cl.
*G09G 3/36* (2006.01)

(52) U.S. Cl.
CPC ..... *G09G 3/3688* (2013.01); *G09G 3/3614* (2013.01); *G09G 2310/027* (2013.01); *G09G 2310/0291* (2013.01); *G09G 2330/021* (2013.01)

(58) Field of Classification Search
CPC combination set(s) only.
See application file for complete search history.

(56) References Cited

U.S. PATENT DOCUMENTS

| | | | | |
|---|---|---|---|---|
| 8,537,088 | B2 * | 9/2013 | Xiao | G09G 3/3688 345/89 |
| 2008/0303750 | A1 * | 12/2008 | Ludden | G09G 3/2092 345/55 |
| 2008/0303836 | A1 * | 12/2008 | Ludden | G09G 3/2092 345/531 |
| 2010/0085375 | A1 * | 4/2010 | Chung | G09G 3/3406 345/589 |
| 2010/0156965 | A1 * | 6/2010 | Kim | G09G 3/3688 345/691 |
| 2010/0245325 | A1 * | 9/2010 | Xiao | G09G 3/3688 345/211 |
| 2012/0133635 | A1 * | 5/2012 | Ji | G09G 3/3688 345/212 |
| 2012/0188224 | A1 * | 7/2012 | Lee | G09G 3/20 345/214 |
| 2014/0184657 | A1 * | 7/2014 | Lee | G09G 5/10 345/690 |

(Continued)

FOREIGN PATENT DOCUMENTS

| | | |
|---|---|---|
| KR | 10-2007-0012176 | 1/2007 |
| KR | 10-2012-0059351 | 6/2012 |
| KR | 10-2012-0085076 | 7/2012 |

*Primary Examiner* — Van Chow
(74) *Attorney, Agent, or Firm* — Kile Park Reed & Houtteman PLLC

(57) ABSTRACT

Provided are a source driver and a display device. The source driver may include: a gamma voltage generation unit configured to select and provide one or more of the gamma voltages in response to a first power down signal; an output buffer unit configured to provide a data voltage to a output terminal in response to a second power down signal; and a selection unit configured to provide the gamma voltage to the output terminal.

5 Claims, 9 Drawing Sheets

(56) References Cited

U.S. PATENT DOCUMENTS

2015/0310812 A1* 10/2015 Chen ..... G09G 3/3696
345/691
2016/0098951 A1* 4/2016 Kim ..... G09G 3/2092
345/209

* cited by examiner

SOURCE DRIVER AND DISPLAY DEVICE INCLUDING THE SAME

BACKGROUND

1. Technical Field

The present disclosure relates to a source driver and a display device including the same.

2. Related Art

With the rapid development of semiconductor technology, display devices have been reduced in size and weight. A flat panel display device such as liquid crystal display (LCD) or organic light emitting diode (OLED) display can be easily reduced in size and weight, but has relatively low power consumption. Thus, a driving device used in the display device (for example, a source driver and a gate driver) also requires low power consumption.

PRIOR ART DOCUMENT

Patent Document (Patent Document 1) KR 10-2012-0059351 (published on Jun. 8, 2012)

SUMMARY

Various embodiments are directed to a source driver having low power consumption.

Also, various embodiments are directed to a display device having low power consumption.

In an embodiment, a source driver may include: a gamma voltage generation unit configured to select and provide one or more of the gamma voltages in response to a first power down signal; an output buffer unit configured to provide a data voltage to a output terminal in response to a second power down signal; and a selection unit configured to provide the gamma voltage to the output terminal.

In another embodiment, a source driver may include: a first output terminal; a first output buffer configured to provide a first data voltage to the first output terminal, at a first period; and a first gamma buffer configured to provide a first gamma voltage to the first output terminal at a second period different from the first period. At the second period, the first output buffer may enter a power down mode.

In another embodiment, a source driver may include: a gamma voltage generation unit configured to generate a plurality of first gamma voltages; a digital analog converter (DAC) configured to output a second gamma voltage corresponding to a gradation value of digital video data, among the plurality of first gamma voltages; an output buffer unit configured to buffer the second gamma voltage and provide a data voltage to an output terminal; and a selection unit configured to select a part of the plurality of first gamma voltages, and provide the selected first gamma voltage to the output terminal.

In another embodiment, there is provided a display device including a source driver coupled to a plurality of data lines of a display panel. The source driver may include: a channel; an output buffer configured to provide a data voltage to the channel, at a first period; and a gamma buffer configured to provide a gamma voltage to the channel, at a second period different from the first period. At the second period, the output buffer may enter a power down mode.

DETAILED DESCRIPTION

Figure 1:
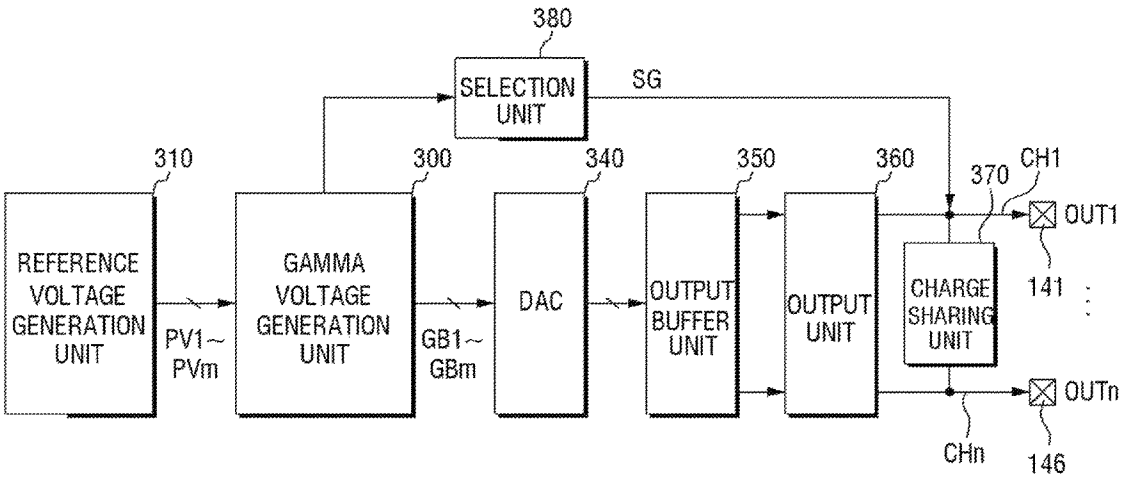
FIG. 1 is a block diagram for describing a source driver in accordance with a first embodiment of the present invention.

Exemplary embodiments will be described below in more detail with reference to the accompanying drawings. The disclosure may, however, be embodied in different forms and should not be constructed as limited to the embodiments set forth herein. Rather, these embodiments are provided so that this disclosure will be thorough and complete, and will fully convey the scope of the disclosure to those skilled in the art. Throughout the disclosure, like reference numerals refer to like parts throughout the various figures and embodiments of the disclosure.

When one element is referred to as being "connected to" or "coupled to" another element, it may indicate that the former element is directly coupled or coupled to the latter element or another element is interposed therebetween. On the other hand, when one element is referred to as being "directly connected to" or "directly coupled to" another element, it may indicate that no element is interposed therebetween. Throughout the disclosure, like reference numerals refer to like elements. Furthermore, "and/or" includes each of described items and one or more combinations thereof.

Although the terms such as first and second are used to describe various elements, components, and/or sections, the elements, components, and/or sections are not limited to the terms. The terms are used only to distinguish one element, component, or section from another element, component, or section. Thus, a first element, first component, or first section described below may indicate a second element, second component, or second section within the scope of the present invention.

The terms used in this specification are used only to explain embodiments while not limiting the present invention. In the specification, the terms of a singular form may include plural forms unless referred to the contrary. The meaning of "comprise" or "comprising" used in the specification specifies a component, a step, an operation, and/or element but does not exclude other components, steps, operations, and/or elements.

All of the terms used in this specification will be used as meanings which can be commonly understood by those skilled in the art to which the present invention pertains, as long as the terms are defined as different meanings. The terms may include technical and scientific terms. Furthermore, terms defined in generally used dictionaries must not be analyzed ideally or overstated unless defined specifically.

FIG. 1 is a block diagram for describing a source driver in accordance with a first embodiment of the present invention.

Referring to FIG. 1, the source driver in accordance with the first embodiment of the present invention may include a reference voltage generation unit 310, a gamma voltage generation unit 300, a digital analog converter (DAC) 340, an output buffer unit 350, an output unit 360, a charge sharing unit 370, a selection unit 380, and output terminals 141 and 146.

The reference voltage generation unit 310 includes a plurality of resistors coupled in series to each other. The reference voltage generation unit 310 generates a plurality of reference voltages PV1 to PVm by dividing a difference between an upper supply voltage and a lower supply voltage. The gamma voltage generation unit 300 receives the plurality of reference voltages PV1 to PVm, and generates a plurality of gamma voltages GB1 to GBm using the reference voltages PV1 to PVm. The DAC 340 receives the plurality of gamma voltages GB1 to GBm, and outputs a gamma voltage corresponding to the gradation value of digital video data among the gamma voltages GB1 to GBm. The output buffer unit 350 buffers the gamma voltage outputted from the DAC 340, and provides the buffered gamma voltage as data voltages OUT1 to OUTn to the output terminals 141 to 146. The output unit 360 may include a plurality of switches, and selectively output the data voltages OUT1 to OUTn. The charge sharing unit 370 may be formed between channels CH1 to CHn or the output terminals 141 to 146, and selectively short the channels CH1 to CHn or the output terminals 141 to 146.

Figure 2:
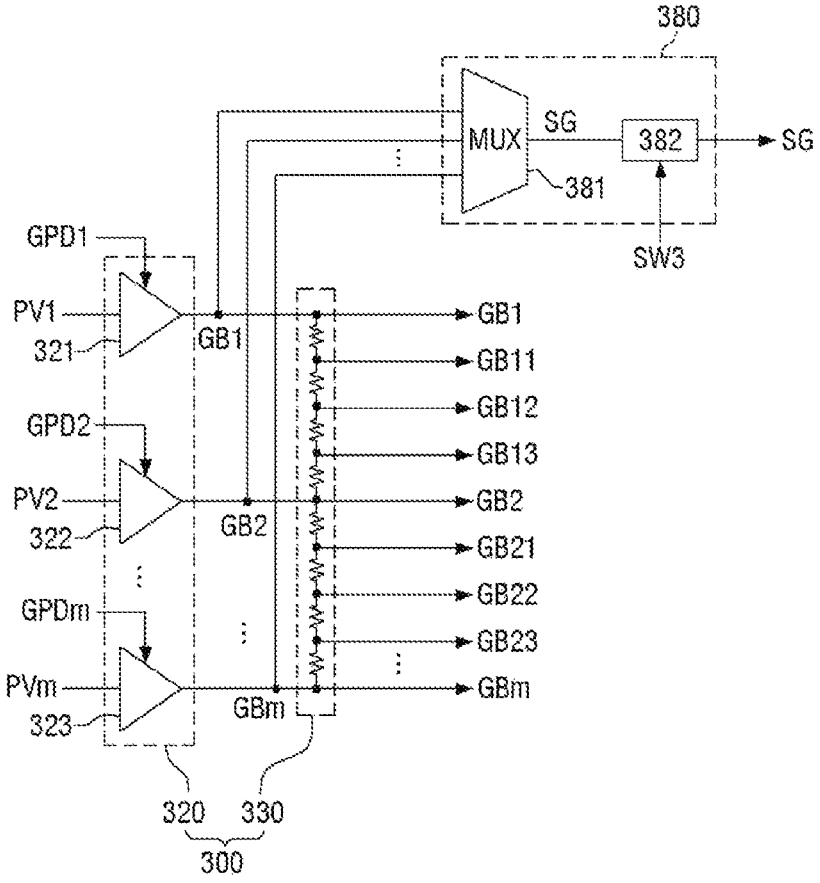
FIG. 2 is a circuit diagram for describing a gamma voltage generation unit and a selection unit of FIG. 1.

The selection unit 380 selectively receives at least a part of the plurality of gamma voltages GB1 to GBm generated through the gamma voltage generation unit 300. The selection unit 380 may select a part of the received gamma voltages GB1 to GBm, and provide the selected voltages to the channels CH1 to CHn. FIG. 2 is a circuit diagram for describing the gamma voltage generation unit and the selection unit of FIG. 1.

Referring to FIG. 2, the gamma voltage generation unit 300 includes a gamma voltage buffer unit 320 and a resistor string 330.

The gamma voltage buffer unit 320 may include first to m-th gamma buffers 321 to 323, for example. The first to m-th gamma buffers 321 to 323 may receive the corresponding reference voltages PV1 to PVm from the reference voltage generation unit 310.

The first to m-th gamma buffers 321 to 323 may receive first power down signals GPD1 to GPDm. When at least a part of the first power down signals GPD1 to GPDm (for example, GPD1 and GPD2) is enabled, the corresponding gamma buffers 321 and 322 enter a power down mode, and the other gamma buffer 323 provides the gamma voltage GBm to the selection unit 380.

For example, the first power down signals GPD1 and GPD2 may be disabled at a first period (for example, normal display period), and enabled at a second period (for example, blank period). When the gamma buffers 321 and 322 enter the power down mode, the current consumption of the gamma buffers 321 and 322 may become zero, and the outputs of the gamma buffers 321 and 322 may be set in a floating state.

Although described below, a gamma buffer (for example, 323) corresponding to the gamma voltage GBm selected by a multiplexer 381 of the selection unit 380 maintains a normal operation state during the second period. On the other hand, the gamma buffers 321 and 322 corresponding to the gamma voltages GB1 and GB2 which are not selected by the multiplexer 381 of the selection unit 380 may enter the power down mode at the second period.

The resistor string 330 may include a plurality of resistors coupled in series to each other. The resistor string 330 divides the received gamma voltages GB1, GB2, and GBm and generates a plurality of gamma voltages GB11, GB12, GB13, GB21, GB22, GB23 and the like. For example, the resistor string 330 divides a difference between the gamma voltages GB1 and GB2, and additionally generates the plurality of gamma voltages GB11, GB12, GB13 and the like.

The selection unit 380 may include the multiplexer 381 and a select switch 382.

The multiplexer 381 is coupled to an output terminal of the gamma voltage buffer unit 320. The multiplexer 381 may receive the first to m-th gamma voltages GB1 to GBm, for example, and select a part of the first to m-th gamma voltages GB1 to GBm. The multiplexer 381 may select and output any one gamma voltage (for example, GBm). In FIG. 2, the selected gamma voltage is represented by SG. The selected gamma voltage SG may be provided to the first channel CH1, for example.

Figure 3:
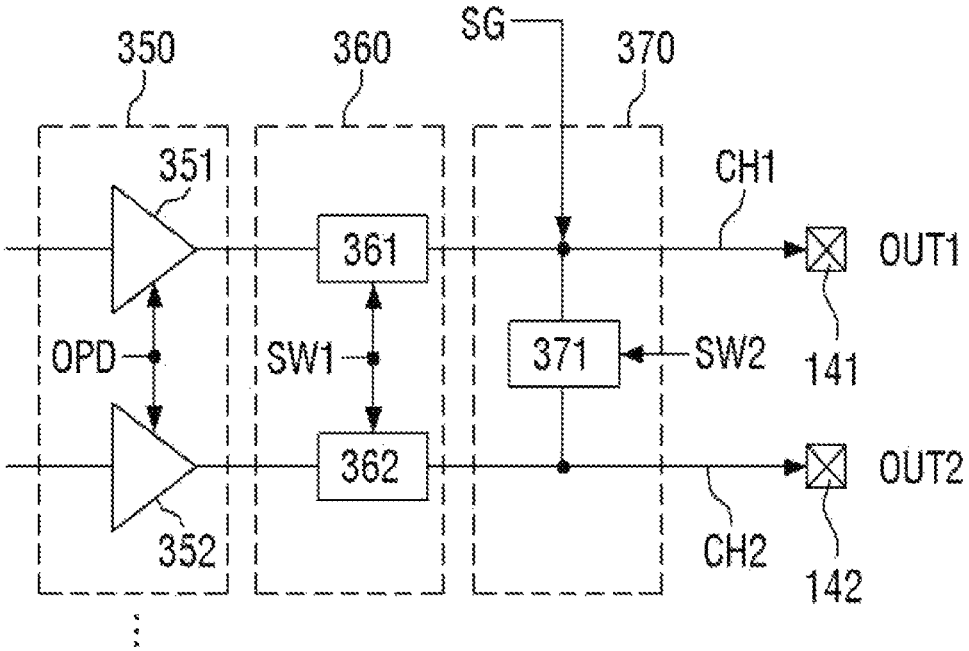
FIG. 3 is a block diagram for describing an output buffer unit, an output unit, and a charge sharing unit of FIG. 1.

FIG. 3 is a block diagram for describing the output buffer unit, the output unit, and the charge sharing unit of FIG. 1.

Referring to FIG. 3, the output buffer unit 350 may include plural pairs of output buffers 351 and 352. FIG. 3 illustrates two output buffers 351 and 352, but the present invention is not limited thereto. That is, depending on the number of channels, the number of output buffers may be changed. The pair of output buffers 351 and 352 are driven in different driving ranges. Between pair of output buffers 351 and 352, one may serve as a positive output buffer, and the other may serve as a negative output buffer.

Each of the channels CH1 and CH2 indicates a region divided for the corresponding data line. The channels CH1 and CH2 include the output buffers 351 and 352, the output terminals 141 and 142, and paths connected to the output terminals 141 and 142 corresponding to the output buffers 351 and 352. The channels CH1 and CH2 are coupled to the corresponding data lines.

The output buffers 351 and 352 output the data voltages OUT1 and OUT2 to the corresponding data lines through the output terminals 141 and 142, respectively.

The first and second output buffers 351 and 352 may be controlled by a second power down signal OPD. When the second power down signal OPD is enabled, the first and second output buffers 351 and 352 may enter the power down mode. For example, the second power down signal OPD may be disabled at the first period (for example, normal display period), and enabled at the second period (for example, blank period). When output buffers (for example, 351 and 352) enter the power down mode, the current consumption of the output buffers 351 and 352 may become zero, and the outputs of the output buffers 351 and 352 may be set in a floating state.

The output unit 360 may include a plurality of data line switches 361 and 362. The first data line switch 361 may be arranged between the first output buffer 351 and the first output terminal 141, and the second data line switch 362 may be arranged between the second output buffer 352 and the second output terminal 142. FIG. 3 illustrates two data line switches 361 and 362, but the present invention is not limited thereto. That is, depending on the number of channels, the number of data line switches may be changed. The plurality of data line switches 361 and 362 may be turned on/off in response to a first switching signal SW1. The first switching signal SW1 may include a signal obtained by inverting a source output enable signal SOE.

The charge sharing unit 370 may include a plurality of charge sharing switches 371. FIG. 3 illustrates one charge sharing switch 371, but the present invention is not limited thereto. That is, depending on the number of channels, the number of charge sharing switches may be changed. The plurality of charge sharing switches 371 may be turned on/off in response to a second switching signal SW2. The second switching signal SW2 may be defined as a signal which is enabled at the blank period of the display device. Furthermore, the turn-on/off of the first charge sharing switch 371 may be determined according to the operation period. For example, the first charge sharing switch 371 may be turned off at the first period (for example, normal display period). Furthermore, the first charge sharing switch 371 may be turned on at the second period (for example, blank period). That is, the first and second output terminals 141 and 142 may be electrically shorted to each other.

For example, the first charge sharing switch 371 may couple the output terminals 141 and 142 corresponding to the pair of output buffers 351 and 352 which are driven in different driving ranges, such that the selected gamma voltage SG is shared by the output terminals 141 and 142. Hereafter, referring to FIGS. 2 and 3, a method for driving the source driver in accordance with the first embodiment of the present invention will be described.

During the first period (for example, normal display period), the select switch 383 is turned off. The charge sharing switch 371 may be turned off. The data line switches 361 and 362 may be repetitively turned on/off according to the source output enable signal SOE. Furthermore, the first power down signals GPD1 to GPDm and the second power down signal OPD are disabled.

The gamma voltage buffer unit 320 receives the reference voltages PV1 to PVm, and buffers the received voltages. The resistor string 330 divides the received gamma voltages GB1, GB2, and GBm and generates the plurality of gamma voltages GB11, GB12, GB13 and the like. The DAC 340 receives the plurality of gamma voltages GB11, GB12, GB13 and the like, and outputs the gamma voltages GB1 to GBm corresponding to the gradation value of digital video data. The output buffer unit 350 buffers the gamma voltages GB1 to GBm and provides the buffered voltages as the data voltages OUT1 and OUT2. Whenever the output unit 360 is turned on, the data voltages OUT1 and OUT2 are outputted through the corresponding channels CH1 and CH2.

During the first period (for example, normal display period), the select switch 382 is turned off. The charge sharing switch 371 may be turned off. The data line switches 361 and 362 may be repetitively turned on/off according to the source output enable signal SOE. Furthermore, the first power down signals GPD1 to GPDm and the second power down signal OPD are disabled.

The multiplexer 381 selects and outputs any one of the plurality of gamma voltages GB1 to GBm. The selected gamma voltage is represented by SG. For example, when the selected gamma voltage SG is the first gamma voltage GB1, the first gamma buffer 321 to output the first gamma voltage GB1 is enabled. That is, the first power down signal GPD1 corresponding to the first gamma buffer 321 may be disabled. On the other hand, the power down signals GPD2 and GPDm corresponding to the other gamma buffers 322 and 323 may be enabled, and thus the other gamma buffers 322 and 323 may enter the power down mode.

The selected gamma voltage SG may be provided to a preset channel (for example, CH1) or the output terminal 141. Since the charge sharing switch 371 is turned on, the selected gamma voltage SG may be transmitted to all of the channels CH1 and CH2 or the output terminals 141 and 142.

Thus, during the blank period, a small number of gamma buffers (for example, 321) may be used to provide the same voltage to a large number of output terminals (for example, all of the output terminals 141 and 142). Since the other gamma buffers 322 and 323 and all of the output buffers 351 and 352 enter the power down mode, the power consumption of the blank period can be minimized.

The selection unit 380 selects and outputs any one of the plurality of gamma voltages GB1, GB2, and GBm, using the multiplexer 381. Thus, gradation to be outputted at the blank period may be easily controlled. For example, the selection unit 380 may output the first gamma voltage GB1 when a first gradation level is intended to be outputted at the blank period, or output the second gamma voltage GB2 when a second gradation level is intended to be outputted.

In order to simplify the design, all of the gamma buffers 321 to 323 may be enabled regardless of the selected gamma voltage (for example, GB1), at the blank period. In this case, one power down signal (for example, GPD1) may be inputted to all of the gamma buffers 321 to 323. Although such a configuration is applied, power consumption can be considerably reduced when all of the output buffers 351 and 352 enter the power down mode at the blank period.

Figure 4:
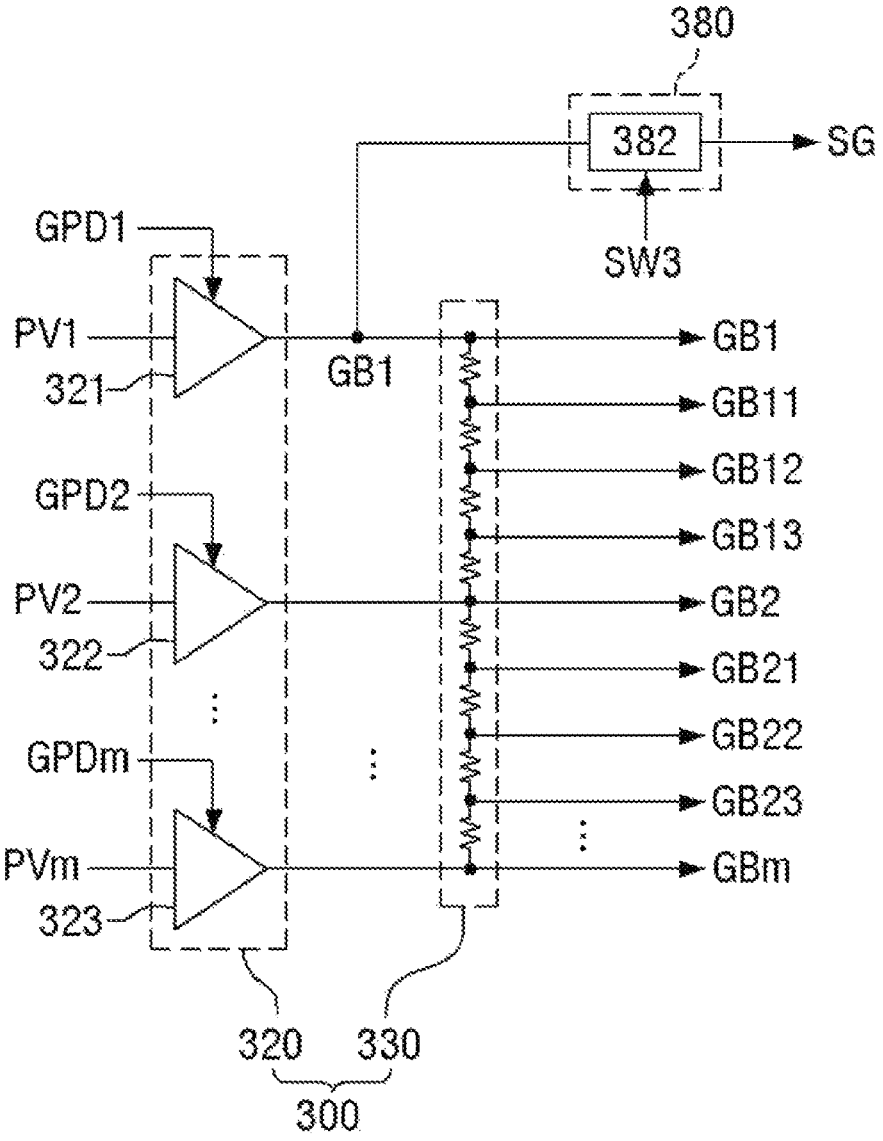
FIG. 4 is a block diagram for describing a source driver in accordance with a second embodiment of the present invention.

FIG. 4 is a block diagram for describing a source driver in accordance with a second embodiment of the present invention. The following descriptions will be focused on differences from those described with reference to FIGS. 1 to 3.

Referring to FIG. 4, the selection unit 380 included in the source driver in accordance with the second embodiment of the present invention does not include a multiplexer. The source driver in accordance with the second embodiment of the present invention may be used when degradation to be outputted at the blank period is predetermined. FIG. 4 illustrates that the first gamma voltage GB1 is transmitted to the first channel CH1 through the select switch 382, but the present is not limited thereto. That is, depending on design, the second gamma voltage GB2 or the m-th gamma voltage GBm may be provided.

Figure 5:
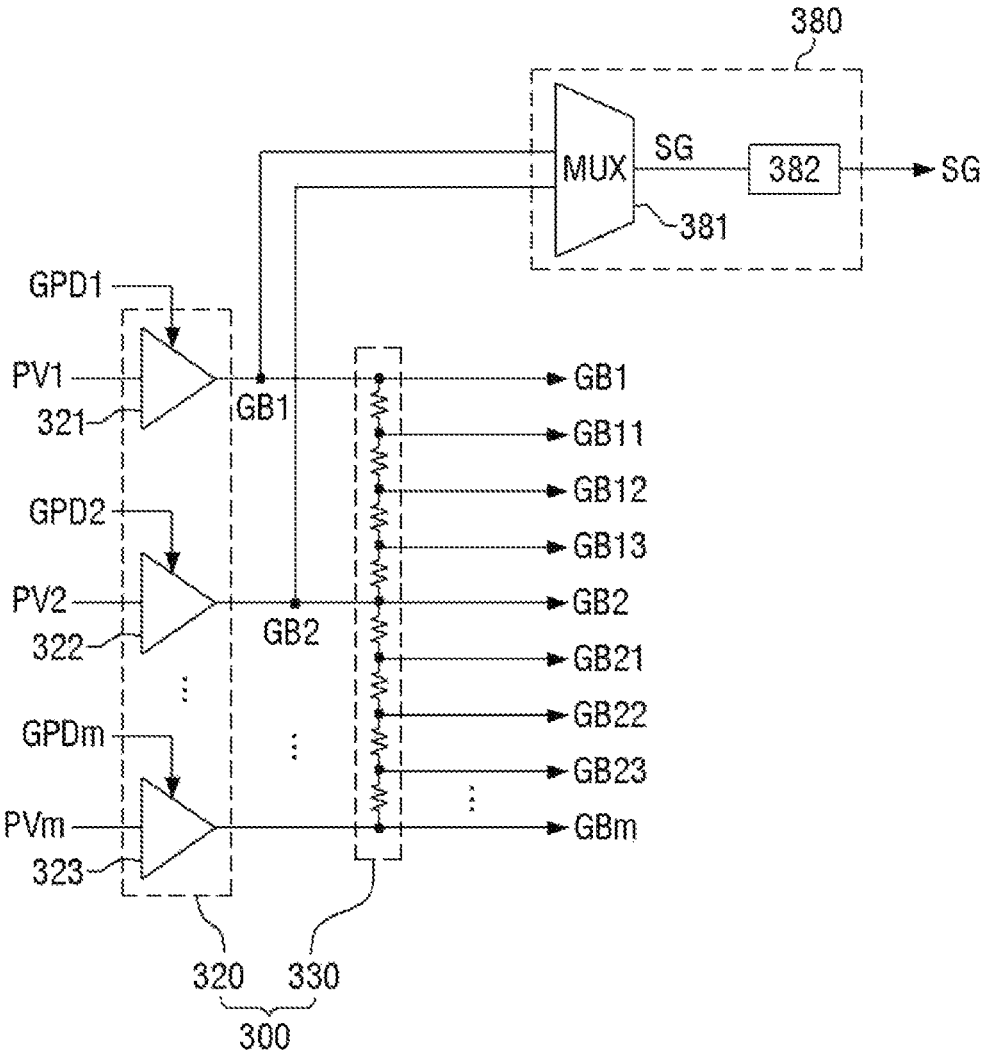
FIG. 5 is a block diagram for describing a source driver in accordance with a third embodiment of the present invention.

FIG. 5 is a block diagram for describing a source driver in accordance with a third embodiment of the present invention. The following descriptions will be focused on differences from those described with reference to FIGS. 1 to 4.

Referring to FIG. 5, the multiplexer 381 of the selection unit 380 included in the source driver in accordance with the third embodiment of the present invention may not be coupled to all of the gamma voltages GB1, GB2, GBm and the like, but coupled to partial gamma voltages (for example, GB1 and GB2). That is, the types of gamma voltages which can be outputted at the blank period may be previously determined. Thus, the multiplexer 381 may select and output a gamma voltage within a predetermined range. Then, various types of gamma voltages can be outputted at the blank period, and the design may be simplified more than in the first embodiment.

Hereafter, referring to FIGS. 6 and 8, a source driver in accordance with a fourth embodiment of the present invention will be described.

Figure 6:
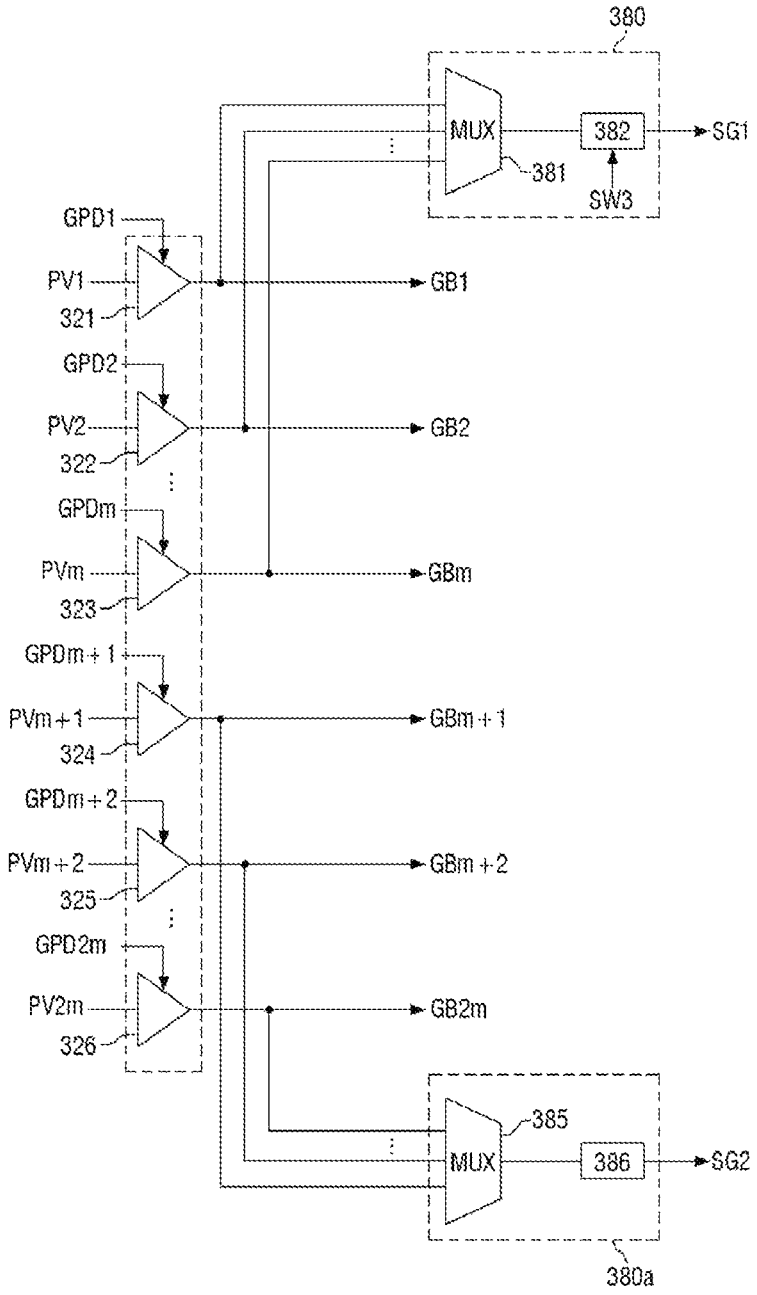
FIG. 6 is a circuit diagram for describing a gamma voltage buffer unit and selection units of a source driver in accordance with a fourth embodiment of the present invention.

FIG. 6 is a circuit diagram for describing a gamma voltage buffer unit and selection units of the source driver in accordance with the fourth embodiment of the present invention. The following descriptions will be focused on differences from those described with reference to FIGS. 1 to 5.

Referring to FIG. 6, the gamma voltage buffer unit 320 includes a plurality of gamma buffers 321 to 326. For example, the first to m-th gamma buffers 321 to 323 may serve as positive gamma buffers, and the (m+1)th to 2m-th gamma buffers 324 to 326 may serve as negative gamma buffers.

The first to m-th gamma buffers 321 to 323 are controlled by first power down signals GPD1 to GPDm, respectively. The (m+1)th to 2m-th gamma buffers 324 to 326 may be controlled by first power down signals GPDm+1 to GPD2*m*, respectively.

The selection unit 380 serves to select a positive gamma voltage, and a selection unit 380*a* serves to select a negative gamma voltage.

Specifically, at the normal display period, a select switch 382 of the selection unit 380 and a select switch 386 of the selection unit 380*a* may be turned off.

On the other hand, at the blank period, a multiplexer 381 of the selection unit 380 receives the first to m-th gamma voltages GB1 to GBm, for example, and select a part of the first to m-th gamma voltages GB1 to GBm. The multiplexer 381 may select and output any one gamma voltage (for example, GBm). The selected gamma voltage SG1 may be provided to a first output terminal 141, for example.

At the blank period, a multiplexer 385 of the selection unit 380*a* receives the (m+1)th to 2m-th gamma voltages GBm+1 to GB2*m*, for example, and selects a part of the (m+1)th to 2m-th gamma voltages GBm+1 to GB2*m*. The multiplexer 385 may select and output any one gamma voltage (for example, GBm+1). The selected gamma voltage SG2 may be provided to an n-th output terminal 146, for example.

For example, the gamma buffers 323 and 324 corresponding to the gamma voltages GBm and GBm+1 selected by the multiplexeres 381 and 385 of the selection units 380 and 380*a* maintain a normal operation state at the second period. On the other hand, the gamma buffers 321, 322, 325, and 326 corresponding to the gamma voltages GB1, GB2, GBm+2, and GB2*m* which are not selected by the multiplexeres 381 and 385 of the selection units 380 and 380*a* may enter the power down mode at the second period.

Figure 7:
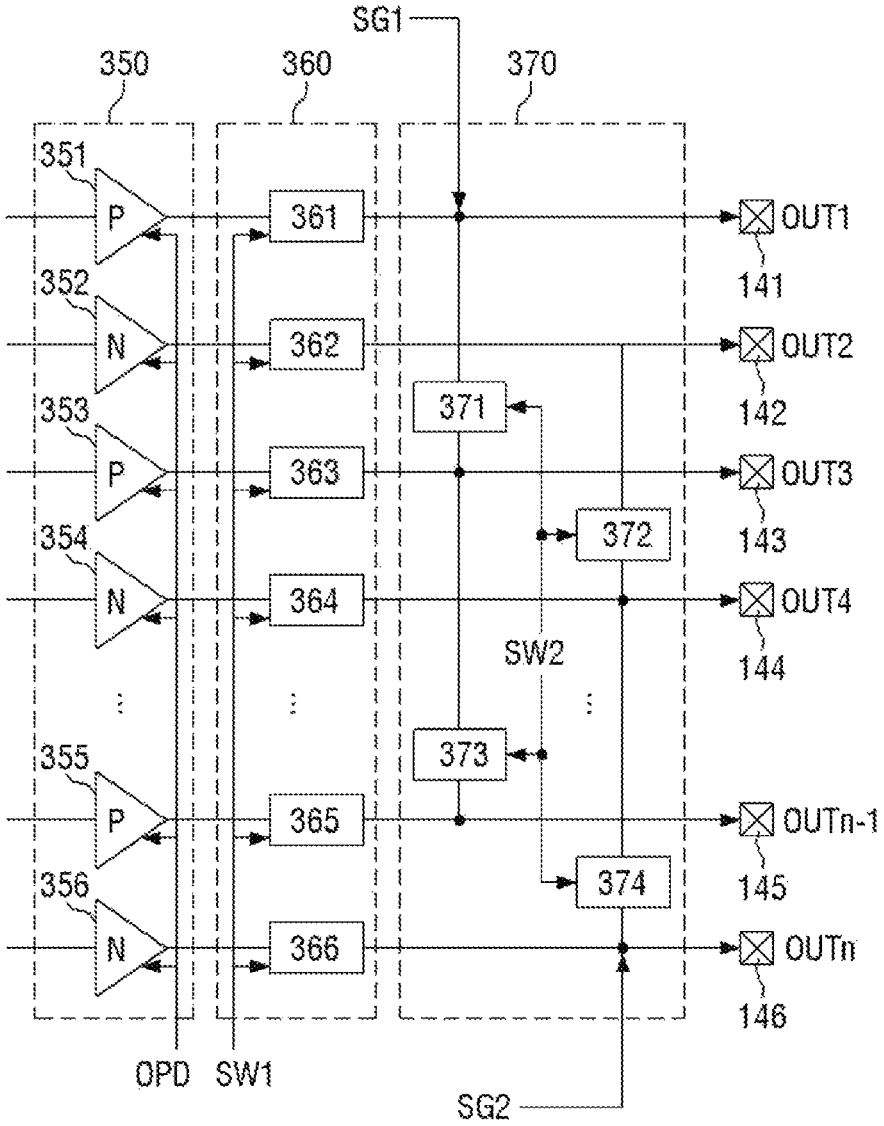
FIG. 7 is a block diagram for describing an output buffer unit, an output unit, and a charge sharing unit of the source driver in accordance with the fourth embodiment of the present invention.

FIG. 7 is a block diagram for describing an output buffer unit, an output unit, and a charge sharing unit of the source driver in accordance with the fourth embodiment of the present invention.

Referring to FIG. 7, the output buffer unit 350 may include first to sixth output buffers 351 to 356. The first to sixth output buffers 351 to 356 may be coupled to the channels CH1 to CHn corresponding one-to-one thereto.

The first, third, and fifth output buffers 351, 353, and 355 may serve as positive output buffers, and the second, fourth, and sixth output buffers 352, 354, and 356 may serve as negative output buffers. The first to sixth output buffers 351 to 356 may be controlled by the second power down signal OPD.

The output unit 360 may include a plurality of data line switches 361 to 366. The first data line switch 361 is arranged between the first output buffer 351 and the first output terminal 141, the second data line switch 362 is arranged between the second output buffer 352 and the second output terminal 142, the third data line switch 363 is arranged between the third output buffer 353 and the third output terminal 143, and the fourth data line switch 364 is arranged between the fourth output buffer 354 and the fourth output terminal 144. The fifth data line switch 365 is arranged between the fifth output buffer 355 and the (n−1)th output terminal 145, and the sixth data line switch 366 is arranged between the sixth output buffer 356 and the n-th output terminal 146. The plurality of data line switches 361 to 366 may be turned on/off in response to a first switching signal SW1.

The charge sharing unit 370 may include a plurality of charge sharing switches 371 to 374. The charge sharing unit 370 may couple the plurality of channels CH1 to CH6 or (the output terminals 141 to 146) which receive data voltages with the same polarity. For example, the first charge sharing switch 371 may be coupled between the first and third output terminals 141 and 143, and the second charge sharing switch 372 may be coupled between the second output terminal 142 and the fourth output terminal 144. Furthermore, the third charge sharing switch 373 may be coupled between the third and (n−1)th output terminals 143 and 145, and the fourth charge sharing switch 374 may be coupled between the fourth channel CH4 and the n-th output terminal 146. The plurality of charge sharing switches 371 to 374 may be turned on/off in response to a second switching signal SW2.

Furthermore, the turn-on/off of the charge sharing switches 371 to 374 may be determined according to the operation period. For example, the plurality of charge sharing switches 371 to 374 may be turned off at the first period (for example, normal display period). Furthermore, the plurality of charge sharing switches 371 to 374 may be turned on at the second period (for example, blank period). That is, the first, third, and (n−1)th output terminals 141, 143, and 145 may be electrically shorted to each other, and the second, fourth, and n-th output terminals 142, 144, and 146 may be electrically shorted to each other.

Thus, although all of the output buffers 351 to 356 enter the power down mode at the blank period, the selected gamma voltage SG1 is provided to the first, third, and (n−1)th output terminals 141, 143, and 145, and the selected gamma voltage SG2 is provided to the second, fourth, and n-th output terminals 142, 144, and 146.

Thus, during the blank period, a small number of gamma buffers (for example, 323 and 324) may be used to provide the same voltage to a large number of output terminals (for example, all of the output terminals 141 to 146). Since the other gamma buffers 321, 322, 325, and 326 and all of the output buffers 351 to 356 enter the power down mode, the power consumption of the blank period can be minimized.

Figure 8:
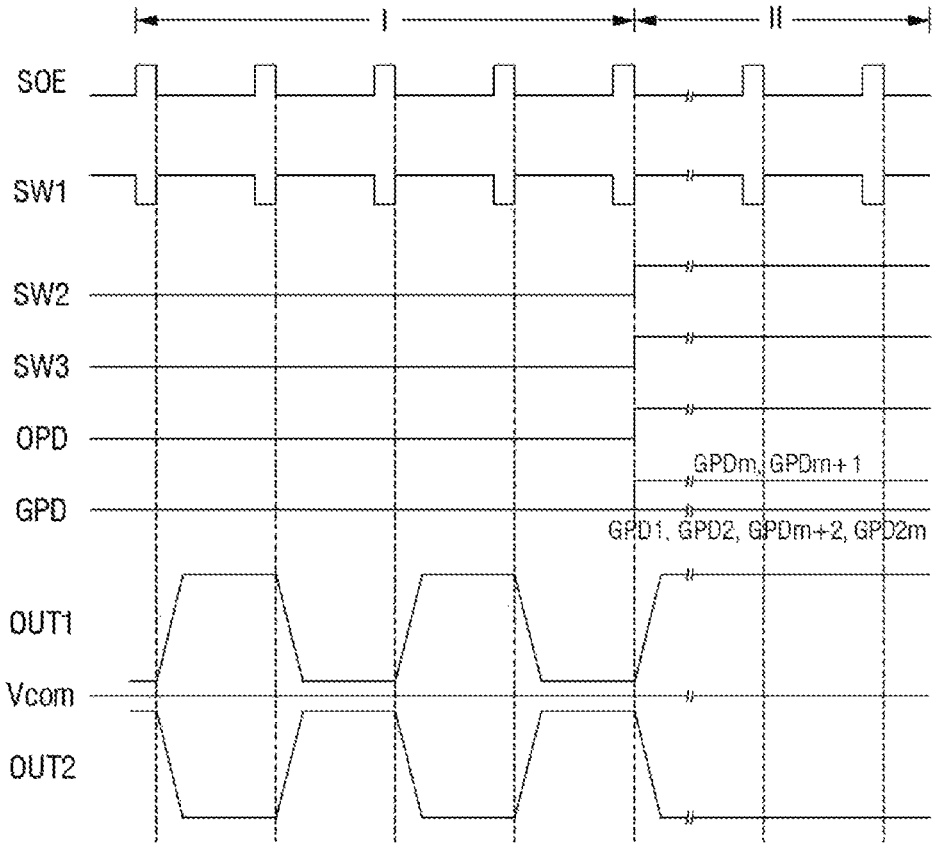
FIG. 8 is a timing diagram for describing a method for driving the source driver of FIGS. 6 and 7.

FIG. 8 is a timing diagram for describing a method for driving the source driver of FIGS. 6 and 7.

Referring to FIGS. 6 to 8, a first period I may correspond to the normal display period, and a second period II may correspond to the blank period.

During the first period I, the first power down signal GPD and the second power down signal OPD are disabled (for example, low level). Thus, the gamma buffers 321 to 326 and the output buffers 351 to 356 perform a normal operation.

Since the first, third, and fifth output buffers 351, 353, and 355 are positive output buffers, a data voltage (for example, OUT1) may swing in a region where the data voltage is larger than a common voltage Vcom as illustrated in FIG. 8. Furthermore, since the second, fourth, and sixth output buffers 352, 354, and 356 are negative output buffers, a data voltage (for example, OUT2) may swing in a region where the data voltage is smaller than the common voltage Vcom as illustrated in FIG. 8. The source output enable signal SOE may be periodically enabled to determine output timings of the data voltages OUT1 to OUTn. As described above, the first switching signal SW1 may include a signal obtained by inverting the source output enable signal SOE. Thus, whenever the source output enable signal SOE is enabled to a high level, the output buffers 351 to 356 output the first to n-th data voltages OUT1 to OUTn.

The second switching signal SW2 is disabled (for example, low level). Thus, the plurality of charge sharing switches 371 to 374 are turned off. Therefore, the channels CH1 to CHn may be electrically isolated from each other, and the output terminals 141 to 146 may receive the data voltages OUT1 to OUTn from the corresponding output buffers 351 to 356.

During the second period II, a part of the first power down signals (for example, GPDm and GPDm+1) are enabled (for example, high level), and the other first power down signals GPD1, GPD2, GPDm+2, and GPD2*m* are disabled. The second power down signal OPD is enabled (for example, high level).

Furthermore, the second switching signal SW2 is enabled (for example, high level). Thus, the plurality of charge sharing switches 371 to 374 are turned on.

Furthermore, the third switching signal SW3 is enabled (for example, high level). Thus, the plurality of select switches 382 and 386 are turned on.

Thus, the m-th gamma buffer 323 may provide the same voltage to the first, third, and (n−1)th output terminals 141, 143, and 145. The (m+1)th gamma buffer 324 may provide the same voltage to the second, fourth, and n-th output terminals 142, 144, and 146.

At the second period II, t channels may be controlled through s gamma buffers where t is a natural number equal to or more than two and s is a natural number smaller than t.

Thus, the numbers of gamma buffers and output buffers which are used at the second period II are smaller than the numbers of gamma buffers and output buffers which are used at the first period I. Therefore, the power consumption of the second period II can be reduced.

Figure 9:
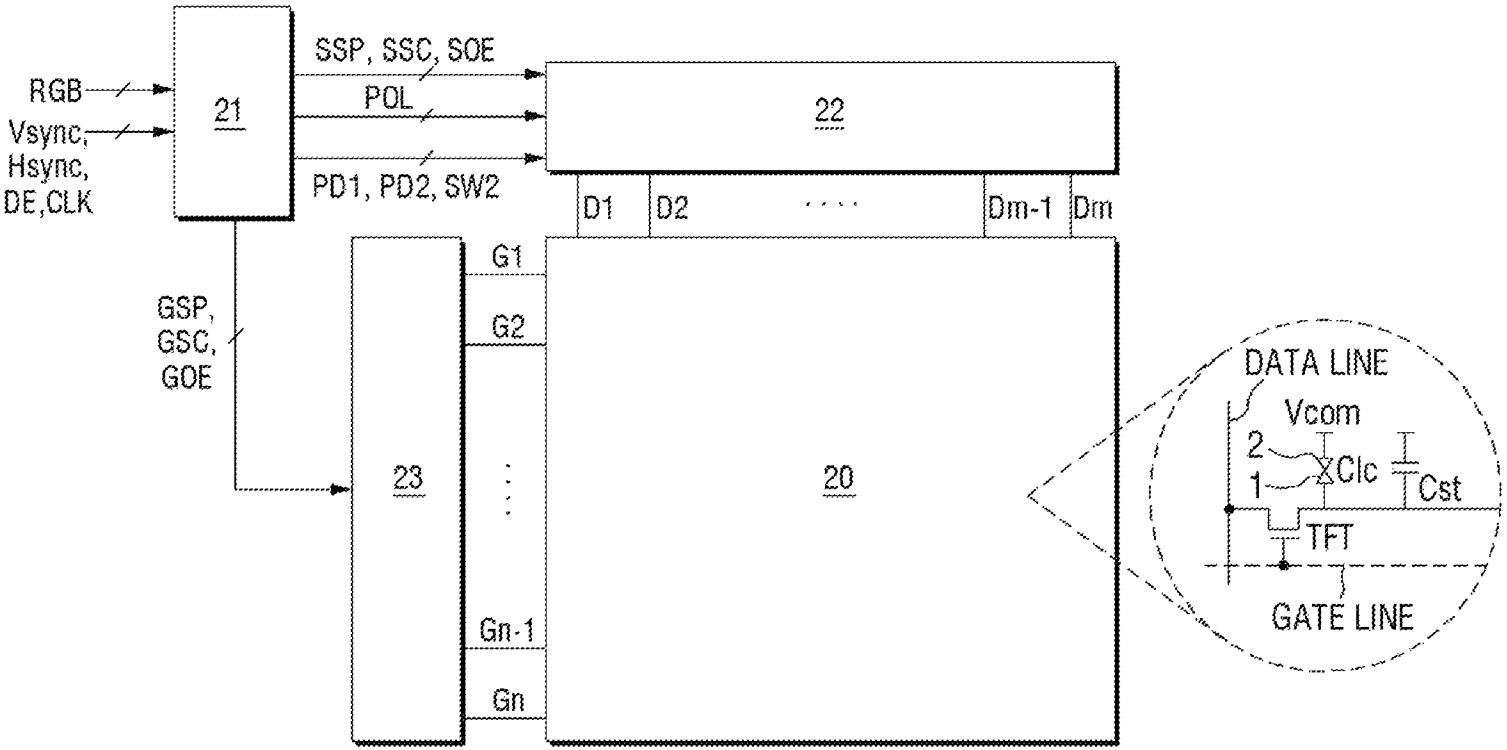
FIG. 9 is a block diagram for describing a display device in accordance with an embodiment of the present invention.

FIG. 9 is a block diagram for describing a display device in accordance with an embodiment of the present invention. FIG. 9 illustrates a display device to which the source driver described with reference to FIGS. 1 to 8 is applied. For convenience of description, an LCD device will be taken as an example. However, the display device can be applied to a flat panel display device such as OLED.

Referring to FIG. 9, the display device in accordance with the embodiment of the present invention includes a display panel 20, a timing controller 21, a source driver 22, a gate driver 23, and a power control circuit 24.

The display panel 20 includes liquid crystal molecules arranged between two glass substrates, for example. The display panel 20 includes m×n liquid crystal cells Clc arranged in a matrix shape based on the cross structure of data lines D1 to Dm and gate lines G1 to Gn.

The bottom glass substrate of the display panel 20 has a pixel array formed therein, the pixel array including the m data lines D1 to Dm, the n gate lines G1 to Gn, TFTs, pixel electrodes 1 of the liquid crystal cells Clc connected to the respective TFTs, and storage capacitors Cst.

The top glass substrate of the display panel 20 may include a black matrix, a color filter, and a common electrode 2 formed thereon. The common electrode 2 is formed on the top glass substrate in a vertical electric field driving mode such as TN (Twisted Nematic) mode or VA (Vertical Alignment) mode, and formed on the bottom glass substrate with the pixel electrode 1 in a horizontal electric field driving mode such as IPS (In-Plane Switching) mode or FFS (Fringe Field Switching) mode.

Each of the top and bottom glass substrates included in the display panel 20 has a polarizing plate attached thereon and an alignment film formed on the inner surface thereof which is in contact with liquid crystal. The polarizing plate crosses an optical axis at right angles, and the alignment film serves to set a pre-tilt.

The source driver 22 may include one or more source drivers among the drivers described with reference to FIGS. 1 to 8. The source driver 22 latches digital video data RGB under control of the timing controller 21, converts the digital video data into an analog positive/negative gamma voltage, and generates a positive/negative data voltage. The source driver 22 supplies data voltages to the data lines D1 to Dm. Data driver integrated circuits may be mounted on a TCP (Tape Carrier Package) and bonded to the bottom glass substrate of the display panel 20 by a TAB (Tape Automated Bonding) process.

The gate driver 23 includes a shift register, a level shifter for converting an output signal of the shift register into a swing suitable for TFT driving of a liquid crystal cell, and output buffers connected between the level shifter and gate lines G1 to Gn. The gate driver 23 sequentially supplies scan pulses having a pulse width of one horizontal period to the gate lines G1 to Gn, under control of the timing controller 21. The gate driver 23 may be mounted on a TCP and bonded to the bottom glass substrate of the display panel 20 through the TAB process, or directly formed on the bottom glass substrate with a pixel array by a GIP (Gate driver In Panel) process.

The timing controller 21 realigns digital video data RGB inputted from a system board (not illustrated) according to the display panel 20, and supplies the realigned data to the source driver 22. The timing controller 21 receives a timing signal such as a vertical/horizontal synchronization signal Vsync/Hsync, a data enable signal DE, or a clock signal CLK from the system board, and generates control signals for controlling the operation timings of the source driver 22 and the gate driver 23.

The data timing control signal for controlling the source driver 22 includes a source start pulse SSP, a source sampling clock SSC, a polarity control signal POL, and a source output enable signal SOE. The source start pulse SSP controls a data sampling start timing of the source driver 22. The source sampling clock SSC is a clock signal for controlling a sampling timing of data in the source driver 22, based on a rising or falling edge. The source output enable signal SOE controls an output timing of the source driver 22. The polarity control signal POL controls a horizontal polarity inversion timing of a data voltage outputted from the source driver 22. The logic inversion cycle of the polarity control signal POL is selected as a predetermined horizontal period. For example, the logic of the polarity control signal POL is inverted at a cycle of two horizontal periods when the source driver 22 is controlled through vertical 2-dot inversion, and inverted at a cycle of one horizontal period when the source driver 22 is controlled through vertical 1-dot inversion. The polarity inversion cycle of data voltages which are sequentially outputted through the same channel in the source driver 22 depends on the logic inversion cycle of the polarity control signal POL. The polarities of data voltages which are outputted from adjacent channels of the source driver 22 at the same time are preset to be inverted on a basis of predetermined dot (for example, one dot).

Furthermore, the first power down signals GPD1 to GPDm are selectively enabled at the blank period and control a part of the gamma buffers to enter the power down mode, and the second power down signal OPD controls all of the output buffers to enter the power down mode at the blank period. The second switching signal SW2 may selectively turn on/off a plurality of charge sharing switches. The third switching signal SW3 may selectively turn on/off a plurality of select switches.

The gate timing control signal for controlling the gate driver 23 includes a gate start pulse GSP, a gate shift clock GSC, a gate output enable signal GOE and the like. During one frame period, the gate start pulse GSP is generated once at the same time as the start of the frame period, and generates a first gate pulse. The gate shift clock GSC is a clock signal which is commonly inputted to a plurality of stages forming the shift register, and shifts the gate start pulse GSP. The gate output enable signal GOE controls an output of the gate driver 23.

While various embodiments have been described above, it will be understood to those skilled in the art that the embodiments described are by way of example only. Accordingly, the disclosure described herein should not be limited based on the described embodiments.

What is claimed is:

1. A source driver comprising:

a gamma voltage generation unit comprising gamma buffers configured to generate gamma voltages by buffering reference voltages received, wherein a part of the gamma buffers enter a power down mode in response to first power down signals being enabled, and the other the gamma buffers generate at least one of the gamma voltages in response to the first power down signals being disabled;

an output buffer unit configured to provide a data voltage to a output terminal, and enter the power down mode in response to a second power down signal being enabled; and a selection unit configured to select and provide one of the gamma voltages provided from the gamma voltage generation unit to the output terminal.

2. The source driver of claim 1, wherein the gamma buffers enter the power down mode or provide at least one of the gamma voltages to the selection unit in response to the first power down signals.

3. The source driver of claim 2, wherein a part of the gamma buffers enter the power down mode in response to the first power down signals at a blank period of a display device, and all of a plurality of output buffers included in the output buffer unit enter the power down mode in response to the second power down signal at the blank period.

4. The source driver of claim 1, further comprising a charge sharing unit configured to share charge between the output terminals, wherein the charge sharing unit receives the gamma voltage selected by the selection unit, and provides the gamma voltage to the output terminals corresponding to a pair of output buffers which are driven in different driving ranges.

5. The source driver of claim 1, further comprising a charge sharing unit configured to share charge between the output terminals, wherein the charge sharing unit provides the gamma voltage the output terminals corresponding to output buffers which are driven in the same driving range, among a pair of output buffers and another pair of output buffers.

* * * * *